US005385089A

United States Patent [19]

Newsom

[11] Patent Number: 5,385,089

[45] Date of Patent: Jan. 31, 1995

[54] APPARATUS FOR REPLACING WEAR COMPONENTS IN A RAM BALER

[75] Inventor: Horace R. Newsom, Waco, Tex.

[73] Assignee: Harris Waste Management Group, Inc., Peachtree City, Ga.

[21] Appl. No.: 114,324

[22] Filed: Aug. 30, 1993

[51] Int. Cl.[6] ..... B30B 15/04

[52] U.S. Cl. ..... 100/179; 100/245

[58] Field of Search ..... 100/179, 245, 295

[56] References Cited

U.S. PATENT DOCUMENTS

| | | | |
|---|---|---|---|
| 2,428,672 | 10/1947 | McClellan et al. | 100/245 X |
| 2,575,449 | 11/1951 | Hill et al. | 100/179 |
| 2,850,965 | 9/1958 | Soteropulos | 100/179 |
| 2,923,230 | 2/1960 | Bornzin | 100/179 X |
| 3,603,247 | 9/1971 | Price et al. | 100/139 |
| 3,965,814 | 6/1976 | Manko | 100/245 |
| 4,080,891 | 3/1978 | Manko | 100/215 |
| 4,417,510 | 11/1983 | Sharp | 100/98 R |
| 4,557,190 | 12/1985 | Vezzani | 100/98 R |
| 4,658,719 | 4/1987 | Jackson et al. | 100/218 |
| 4,729,301 | 3/1988 | Smith et al. | 100/43 |
| 4,787,308 | 11/1988 | Newsom et al. | 100/50 |
| 4,997,514 | 3/1991 | Bielfeldt | 156/558 |
| 5,001,974 | 3/1991 | Gombos | 100/4 |
| 5,007,337 | 4/1991 | Newsom | 100/188 |
| 5,069,044 | 12/1991 | Holum et al. | 62/320 |
| 5,081,922 | 1/1992 | Rudd, Jr. et al. | 100/50 |
| 5,088,399 | 2/1992 | Cacace et al. | 100/218 |
| 5,201,266 | 4/1993 | Schmalz et al. | 100/35 |
| 5,247,881 | 9/1993 | Rosser et al. | 100/245 X |

FOREIGN PATENT DOCUMENTS

| | | | |
|---|---|---|---|
| 833650 | 4/1960 | United Kingdom | 100/179 |

*Primary Examiner*—Stephen F. Gerrity
*Attorney, Agent, or Firm*—Kirkpatrick & Lockhart

[57] ABSTRACT

A ram baler includes a charging passageway, a compacting chamber that is coupled to the charging passageway, a main platen, which moves back and forth in at least one direction in the passageway and compacting chamber, a floor, which bears the weight of the main platen, a series of guide strips on the floor, and a series of wear shoes which are attached to the bottom surface of the main platen, and the bottom surface of the main platen having one or more jack bolts or levers that allow for repair of the wear shoes without requiring the removal of the main platen from the baler. Also disclosed is a method for manufacturing a baler that includes forming holes in the bottom surface of the main platen and coupling to the bottom surface of the main platen one or more jack bolts or levers that allow the main platen to have its wear shoes repaired without requiring removal of the main platen from the charging passageway or compacting chamber.

8 Claims, 2 Drawing Sheets

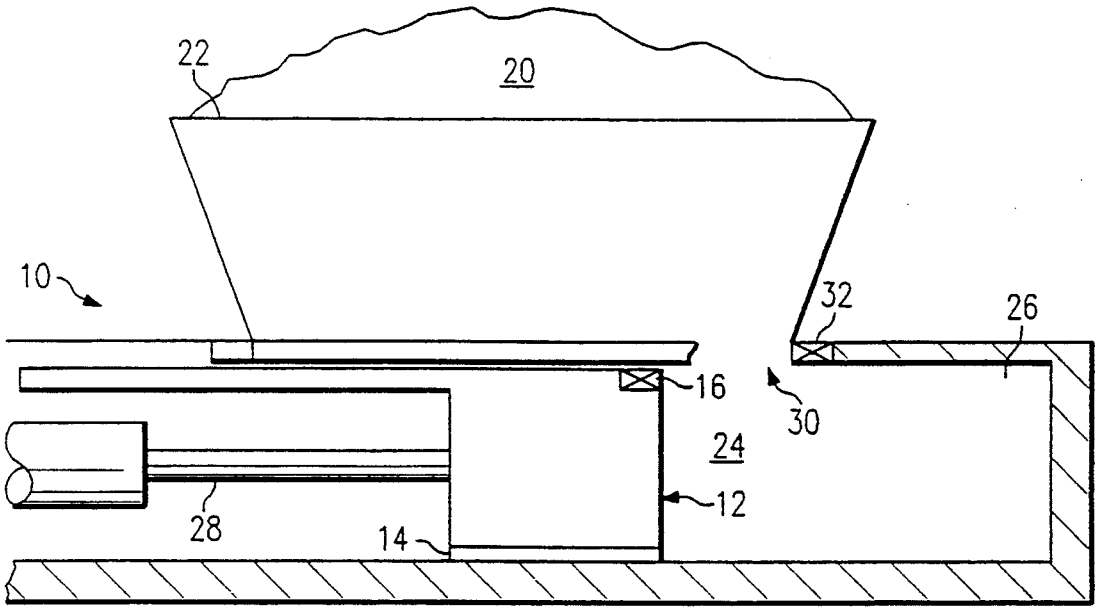
FIG. 1
FIG. 2
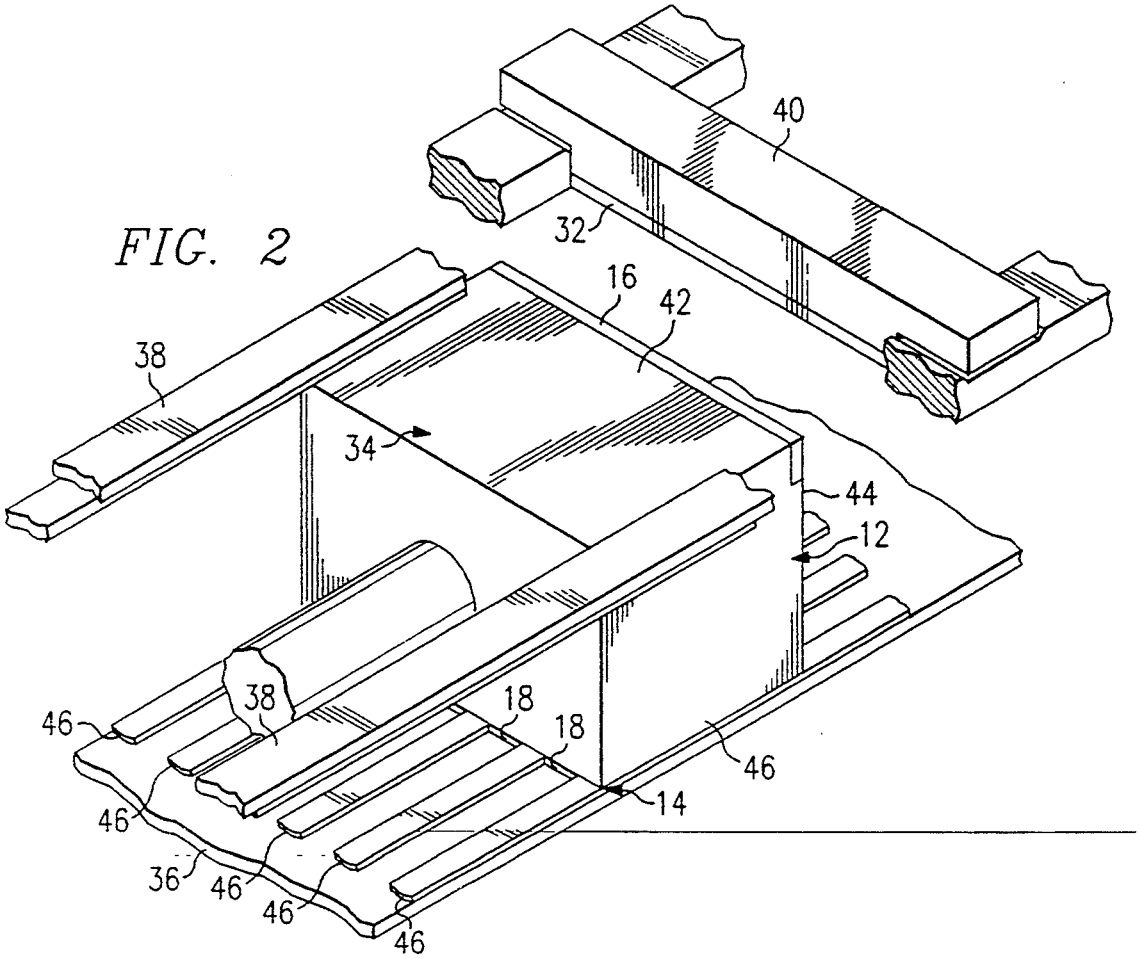

APPARATUS FOR REPLACING WEAR COMPONENTS IN A RAM BALER

TECHNICAL FIELD OF THE INVENTION

The present invention relates generally to devices for baling material such as trash or recyclable material, and more specifically, relates to improvements facilitating repair of the ram balers.

BACKGROUND OF THE INVENTION

Balers are commonly used to compress recyclable or waste material such as aluminum cans and the like into bales and then to strap the bales in order to facilitate transportation of the materials. For example, a two ram baler is described in U.S. Pat. No. 5,007,337 to Newsom, entitled "Oversized Bale Release Mechanism for Waste Material Baler." A ram baler of this type generally comprises a hopper for storing and feeding the material to be baled, a charging passageway, and a baling chamber in which the bale is formed. A main compression ram comprising a hydraulic plunger and a platen is operated within the chamber and charging passageway to compress the material into the shape of a bale, and frequently, a smaller ram ejects the bale into the strapping device. Knives or cutting edges may be incorporated in the baler to separate the material in the hopper from the material in the charging passageway.

Ram balers of the type described have many parts that move relative to each other. Because loaded parts are moving against each other, frictional forces tend to wear down various components. It is frequently then found desirable to include linings against different components to provide an element that can be replaced from time to time. For example, the bottom surface of the platen, which rides on the floor of the baling chamber and charging passageway, wears down with use. A wear shoe may be secured to the bottom of the main platen, and the wear shoes replaced from time to time. Wear shoes typically range from 3 to 12 inches wide and are frequently a half inch thick. In the past, when replacement of wear shoes has been necessary, operators have had to substantially remove the main platen from the baler in order to replace the wear shoes. After removing the main platen from the baler, the wear shoes on the bottom of the platen were replaced as well as the liner on the floor. The removal of the main platen from the baler took considerable effort and may have resulted in increased down time for the machine.

SUMMARY OF THE INVENTION

In accordance with the present invention, a ram baler is provided which substantially eliminates or reduces the disadvantages and problems associated with the prior ram balers.

According to one aspect of the present invention, a ram baler has a main platen containing jack bolts which allow the main platen to be lifted above the floor of the ram baler so as to allow the wear shoes to be removed but without requiring the main platen to be removed from the baler. According to another aspect of the present invention, a method of manufacturing a ram baler is disclosed wherein jack bolts or a jack means is attached to the main platen to allow the main platen to be lifted slightly above the floor so as to allow replacement of the wear shoes without requiring the main platen to be substantially removed from the charging passageway or compacting chamber.

A technical advantage of this invention is that the wear shoes on a platen can be replaced without requiring significant downtime and its associated cost.

BRIEF DESCRIPTION OF THE DRAWINGS

For a more complete understanding of the present invention, and the advantages thereof, reference is now made to the following descriptions taken in conjunction with the accompanying drawings, in which:

FIG. 1 shows a schematic, partial cut-away view of one side of a ram baler;

FIG. 2 shows a schematic top cut-away view of the ram baler of FIG. 1.

DETAILED DESCRIPTION OF THE INVENTION

Figure 3:
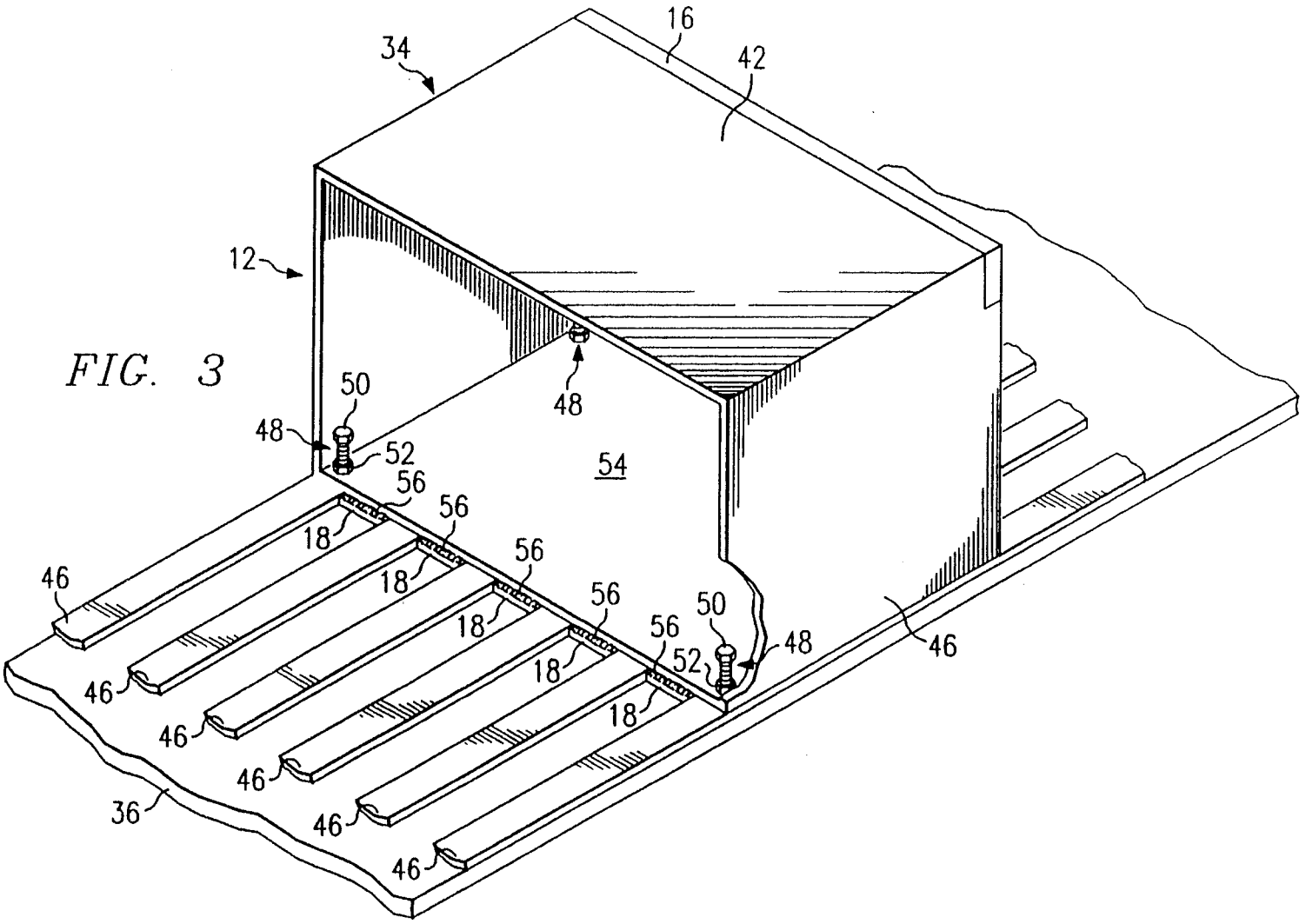
FIG. 3 shows a schematic partial cut-away of a platen showing one aspect of the present invention.

The preferred embodiment of the present invention and its advantages are best understood by referring to FIGS. 1–3 of the drawings, like numerals being used for like and corresponding parts of the various drawings.

FIGS. 1 and 2 show ram baler 10 having a bottom plate assembly 14 in accordance with the invention. A material 20 that is to be baled is loaded into hopper 22 and is fed into charging passageway 24. Charging passageway 24 is in communication with baling chamber or compacting chamber 26. A hydraulic plunger 28 moves platen 12 back and forth along a predetermined path through charging passage 24 and into compacting chamber 26. On its forward stroke, platen 12 compresses material 20 inside baling chamber 24. As platen 12 is retracted by plunger 28, material 20 from hopper 22 falls into charging passageway 24 and a cycle is repeated until compacting chamber 26 is sufficiently full with a compressed bale. When compacting chamber 26 is almost full, material 20 will pile up and this pile will extend into hopper 22 through charging passageway opening 30; this material is cut or separated by the scissor-like action of top cutting edge 32 and bottom cutting edge 16, as platen 12 moves into charging passageway 24. Bottom cutting edge 16 is supported by top assembly 34. Floor 36 of ram baler 10 supports platen 12 as it slides back and forth through charging passageway 24 and compacting chamber 26. Holding bars 38 prevent platen 12 from "riding up" beyond the level of holding bars 38 during operation. Holding bars 38 are removably secured to ram baler 10, such that they may be loosened and removed when necessary or merely loosened to allow movement of platen 12.

FIG. 2 is a partial schematic view of platen 12 on floor 36. A top edge support 40 is secured to holding bars 38, whereas bottom cutting edge 16 is secured to a top assembly 34 of platen 12. Top assembly 34 has a roof plate assembly 42 and a face plate assembly 44. At the intersection of top assembly 34 and face plate assembly 44 is attached bottom cutting edge 16.

Bottom plate assembly 14 is formed by wear shoes or wear liners 18 interacting with guide strips 46. Wear shoes 18 and guide strips 46 mate so as to provide a rail and track system that allow the platen to be guided along the passageway, and providing for a piece 18 which may be replaced when wear becomes substantial.

Referring now to FIG. 3, there is shown a partial cut-away schematic view of platen 12 resting against floor 36. The cut-away of FIG. 3 allows jack bolt assembly 48 to be seen. Each jack bolt 48 has a bolt 50 and a corresponding nut 52. The embodiment shown in FIG. 3 has four jack bolts 48; one in each corner. Of course, varying numbers of jack bolts 48 could be used at varying locations. Main platen 12 has bottom surface 54 to which jack bolts 48 may be coupled. In manufacturing baler 10, holes may be formed in bottom surface 54 that are sized to allow bolt 50 to extend therethrough. After providing holes corresponding to the desired jack bolts 48 in bottom surface 54, nuts 52 may be secured over the holes by techniques known in the art such as welding. After securing nuts 52, bolts 50 may be inserted into the threads of nuts 52. Jack bolts 48 are positioned on bottom surface 54 so that when bolt 50 is extended through the hole in bottom surface 54, the bolt will extend through bottom surface 54 and assert a force on guide strips 46. Nuts 52 may be replaced by threading the holes in bottom surface 54. Thus, when bolt 50 is rotated or moved relative to nut 52, bottom surface 54 main platen 12 may be moved relative to guide strips 46, and after sufficient rotation of bolts 50, a clearance between wear shoes 18 and guide strips 46 is created that allows replacement of wear shoes 18 without requiring removal of main platen 12 from baler 10. Wear shoes 18 may be held to bottom surface 54 of main platen 12 by welding, such as tack welding 56. To facilitate attaching wear shoes 18 to bottom surface 54, wear shoes 18 may be slightly longer than bottom surface 54 such that wear shoes 18 extend approximately an eighth to a fourth of an inch past the edge of bottom surface 54; this technique allows weld 56 to be a simple fillet weld at the end of each wear shoe 18. Wear shoe 18 could also be bolted or attached by other means known in the art.

In operation, wear shoes 18 may be replaced as follows. Once it has been determined that wear shoes 18 need to be replaced, the fasteners associated with holding bars 38 may be loosened to allow main platen 12 to move vertically upward with respect to the frame of reference shown in FIGS. 1 and 2. Once holding bars 38 are loosened, access to jack bolts 48 is gained by the operator who rotates bolts 50 relative to nuts 52 to cause main platen 12 to move vertically upward creating a clearance between wear shoes 18 and guide strips 46. Once a sufficient clearance between wear shoes 18 and guide strips 46 is created, tack welds 56 may be removed and wear shoes 18 removed from bottom surface 54 of platen 12. Then new wear shoes 18 may be placed on bottom surface 54 of platen 12 and secured by tack welds 56. Once wear shoes 18 are secured, jack bolts 48 may be rotated in an opposite direction lowering main platen 12 so that wear shoes 18 and guide strips 46 once again mate and bear the weight of main platen 12. The floor liner or guide strips 46 may also be replaced without removing main platen 12 from baler 10 by forming guide strips 46 in two or more portions such that main platen 12 may be moved to an end opposite the portion of guide strips 46 to be replaced thus allowing removal of the first portion, and after removing the first portion, main platen 12 can be positioned over the newly replaced guide strips 46 and the remaining portion or portions replaced in a similar fashion.

Although the present invention and its advantages have been described in detail, it should be understood that various changes, substitutions and alterations can be made therein without departing from the spirit and scope of the invention as defined by the appended claims. For example, instead of jack bolts 48, a system of lever arms could be used such that when the lever arms are extended, main platen 12 is raised relative to guide strips 46.

What is claimed is:

1. In a ram baler having:

a passageway;

a compacting chamber coupled to the passageway;

a main platen, the main platen reciprocal in at least one direction in the passageway and compacting chamber;

a floor for bearing the weight of the main platen;

at least one guide strip coupled to the floor; and at least one wear shoe associated with the main platen, the wear shoe positioned between the main platen and the floor;

wherein the improvement comprises:

a jack means coupled to the main platen for selectively moving the main platen to allow replacement of the wear shoe without requiring removal of the main platen from the passageway.

2. The device of claim 1, wherein the jack means comprises at least one jack bolt assembly.

3. The device of claim 2, wherein the jack bolt assembly comprises a bolt and a corresponding nut with the nut secured to the bottom surface of the main platen allowing rotation of the bolt to move the main platen relative to the floor.

4. A ram baler comprising:

a hopper;

a compacting chamber;

a charging passageway having a first and second end, the second end in communication with the compacting chamber such that a material forced along the charging passageway from the direction of the first end to the second end may be substantially forced into the compacting chamber, the charging passageway in communication with the hopper to allow the material entering the hopper to be delivered to the charging passageway;

a main platen moveable in the charging passageway and compacting chamber for forcing material through the charging passageway and into the compacting chamber, the main platen having a top and a bottom surface;

a floor for bearing the weight of the main platen;

a plurality of guide strips coupled to the floor;

a plurality of wear shoes coupled to the bottom surface of the main platen, the wear shoes communicating forces between the floor and the main platen, the wear shoes operable in conjunction with the plurality of guide strips to guide the main platen;

a jack means coupled to the main platen for selectively lifting the main platen to allow repair of the wear shoes with the main platen disposed within the charging passageway.

5. The ram baler of claim 4, wherein the wear shoes are welded to the bottom surface of the main platen.

6. The ram baler of claim 4, wherein the wear shoes are tack welded to the main platen.

7. The ram baler of claim 4, wherein the jack means comprises a plurality of jack bolt assembly.

8. The ram baler of claim 7, wherein the lack bolt assemblies comprise a plurality of bolts and nuts with each jack bolt assembly coupled to the main platen by welding the nuts to the bottom surface, and each bolt rotatably disposed in its associated nut to allow movement of the main platen relative to the floor.

* * * * *

UNITED STATES PATENT AND TRADEMARK OFFICE

CERTIFICATE OF CORRECTION

PATENT NO. : 5,385,089
DATED : January 31, 1995
INVENTOR(S) : Horace R. Newsom

It is certified that error appears in the above-indentified patent and that said Letters Patent is hereby corrected as shown below:

Col. 4, 62, Claim 8, line 1, "lack" should be "jack."

Signed and Sealed this

Twelfth Day of September, 1995

*Attest:*

Bruce Lehman

BRUCE LEHMAN

*Attesting Officer*

*Commissioner of Patents and Trademarks*